United States Patent [19]

Anthony et al.

[11] 4,395,200

[45] Jul. 26, 1983

[54] DOWNHOLE OIL WELL PUMP

[76] Inventors: David S. Anthony; Michael D. Anthony, both of 1235 W. Laurel, San Antonio, Tex. 78201

[21] Appl. No.: 218,778

[22] Filed: Dec. 22, 1980

[51] Int. Cl.[3] ..... F04F 1/06

[52] U.S. Cl. ..... 417/131; 417/133

[58] Field of Search ..... 417/131, 133, 121, 138

[56] References Cited

U.S. PATENT DOCUMENTS

| | | | |
|---|---|---|---|
| 1,799,196 | 4/1931 | Schulze | 417/126 |
| 2,007,745 | 7/1935 | Coy et al. | 417/131 |
| 2,474,423 | 6/1949 | Hurley | 417/133 |

FOREIGN PATENT DOCUMENTS

| | | | |
|---|---|---|---|
| 31918 | 1/1934 | Netherlands | 417/121 |

*Primary Examiner*—Richard E. Gluck

*Attorney, Agent, or Firm*—Cox & Smith Incorporated

[57] ABSTRACT

An automatic gas operated downhole fluid pump having an elongated cylindrical chamber for receiving fluid and having a concentrically mounted cylindrical float which is connected to a valve having an actuator biased and retained in either an opened or closed position with an elongated control rod connected with the valve actuator and extending through a passageway through the cylindrical float with adjustable means to adjustably connect the control rod with the cylindrical float to apply force to the actuator only when it is desired to actuate the valve.

1 Claim, 8 Drawing Figures

DOWNHOLE OIL WELL PUMP

BACKGROUND OF THE INVENTION

This invention relates generally to a downhole oil well pump and more particularly to a pump which is air-operated and actuated by the oil level in the well.

It has been known before to provide a downhole oil well pump, which is air-operated and responsive to oil level in the well. An example of this is shown in U.S. Pat. No. 4,092,087, issued May 30, 1978. This device discloses a pumping mechanism using a valve 47 having a reciprocating valve member and locking means to retain the valve member in a closed position. The problem with this device is that the valve is expensive to manufacture and maintain which greatly increases the cost of the pump mechanism. It is very important that the valve mechanism be reliable since the pump is positioned in the well well below the surface. This requires that the valve operate continuously and reliably over a period of time without removal of the pump which increases the cost of pumping the well.

The oil well pump of this invention is used in wells having what is considered marginal production. These wells normally would be shut in due to the cost and difficulty of pumping the small amounts in production which they are capable of producing. In order to make production from such wells justifiable, it is necessary that an inexpensive and reliable pump mechanism be provided which will be dependable in operation in which can operate for periods of time without much maintenance and inspection.

SUMMARY OF THE INVENTION

The invention relates to a downhole air operated oil well pump apparatus which may be positioned in a borehole in stages for sequentially pumping oil to the surface. The apparatus includes a lost-motion valve acuator and a toggle valve having a toggle member moveable between open and closed positions to selectively supply air to the pump when the oil reaches a predetermined level and to cut off the air supply when the oil drops to a second predetermined level due to pumping to the surface or the next stage. The apparatus may be connected in series for deep wells.

BRIEF DESCRIPTION OF THE DRAWINGS

FIG. 2(*a*) is a partial view of a pump stage showing the upper portion.

FIG. 2(*b*) is a partial view of a pump stage showing the lower portion.

FIG. 2(*c*) is a partial view of a pump stage also showing the upper portion.

BRIEF DESCRIPTION OF THE PREFERRED EMBODIMENT

Figure 1:
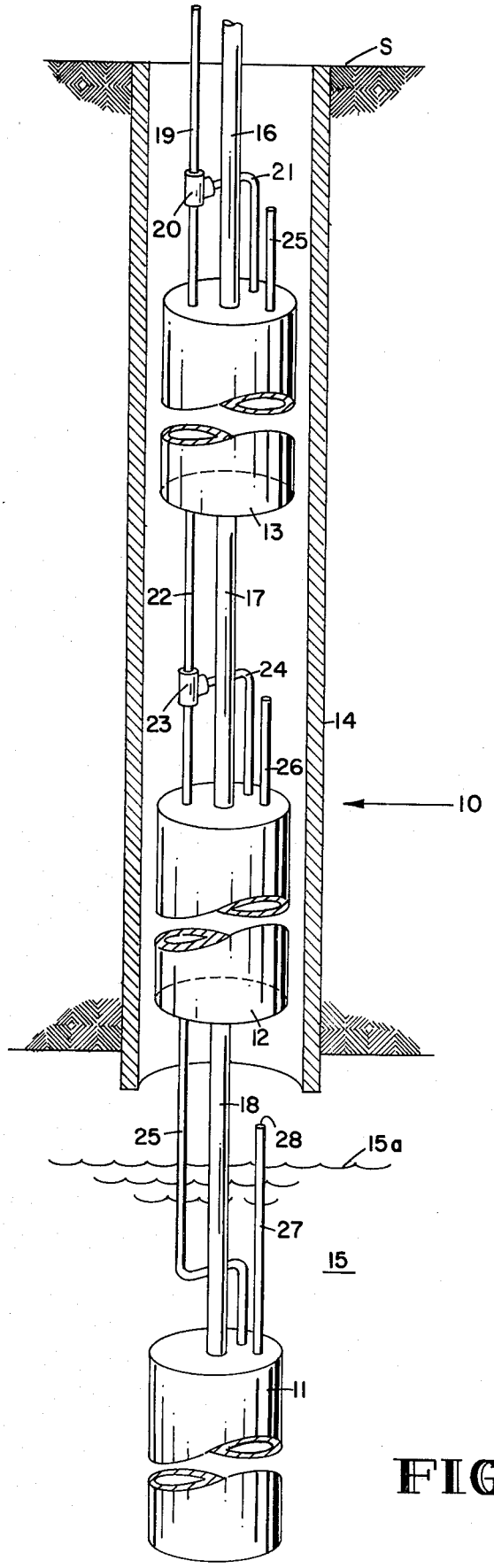
FIG. 1 is a pictorial view showing a series of pumps in stages positioned in a well bore extending from a producing formation to the surface.

Referring to FIG. 1 of the drawings, there is shown a pump system 10 having a plurality of pumping stages 11, 12, and 13 positioned in a tubing string 14 extending into a producing formation 15.

An oil flow line 16 is provided and extends from the surface S to the pumping stage 13. A second oil flow line 17 extends from the pumping stage 13 to the second pumping stage 12. A third oil flow line 18 extends from the pumping stage 12 to the pumping stage 11. Additional oil flow lines and stages could be provided depending on the depth of the formation. An air supply line 19 extends from the surface S to the first stage 13. A tee 20 in the air supply line 19 is connected to a line 21 which supplies air to the pumping stage 13. As will be apparent the air supply line 19 is connected to a suitable source of compressed air to power the pumps for pumping the oil between the various pumping stages and to the surface. Another air supply line 22 is connected to the air supply line 19 and supplies air from the pumping stage 13 to the pumping stage 12. A tee 23 is positioned in the air supply line 22 and is connected to an air supply line 24 which supplies air to the pumping stage 12. The air supply line 22 is connected to an air supply line 25 which extends from the pumping stage 12 to the pumping stage 11. These pumping stages could generally be positioned at three hundred (300) to four hundred (400) feet intervals as is required to pump oil from the well depending on the depth of the formation.

The pumping stage 13 includes an air exhaust line 25 which allows oil to fill the stage and lets air out of the stage. The pumping stage 12 likewise includes an air exhaust line 26 which functions similarly. The pumping stage 11 includes an air exhaust line 27 which has its upper end 28 extending above the upper surface 15(*a*) of the producing formation 15.

Figure 2:
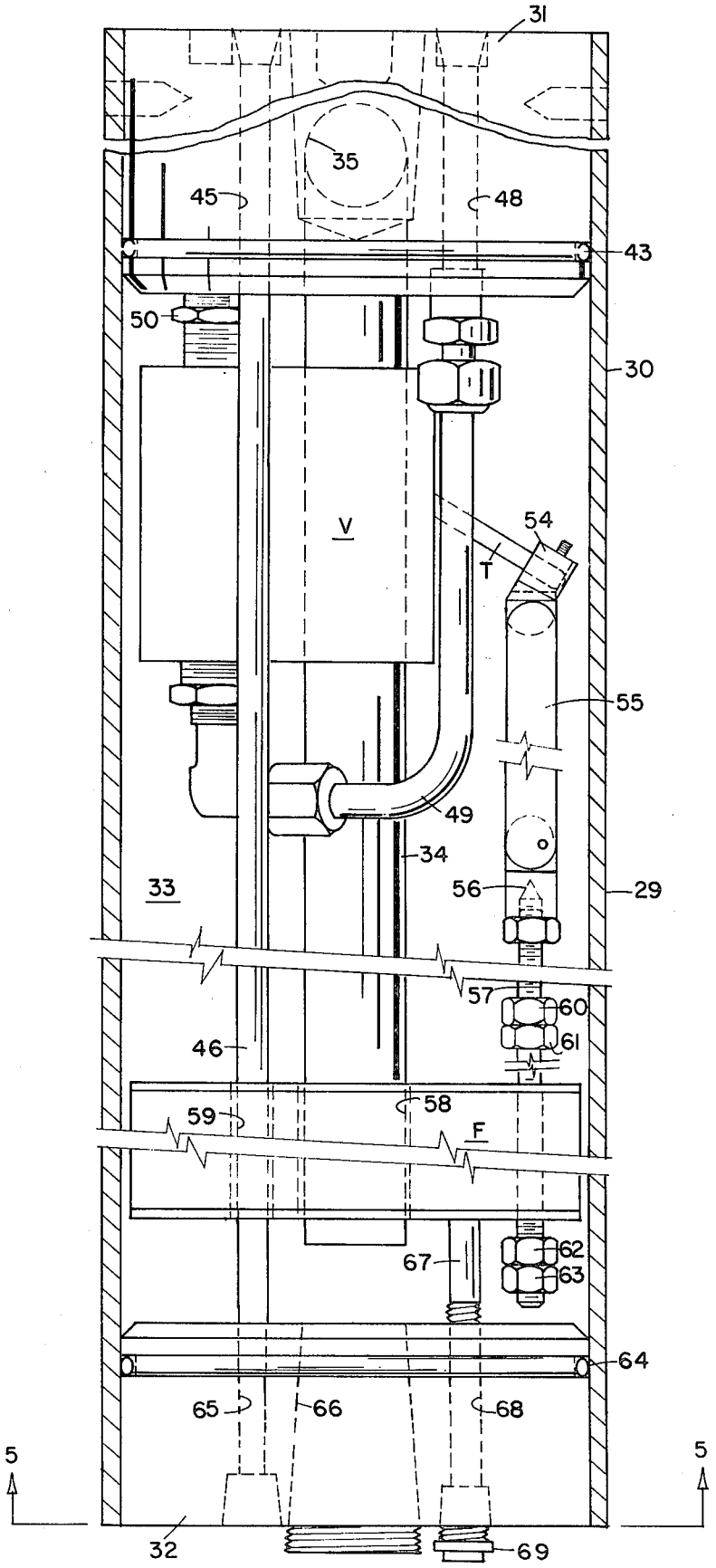
FIG. 2 is a view partly in section showing one of the stages of the pump.
Figure 2A:
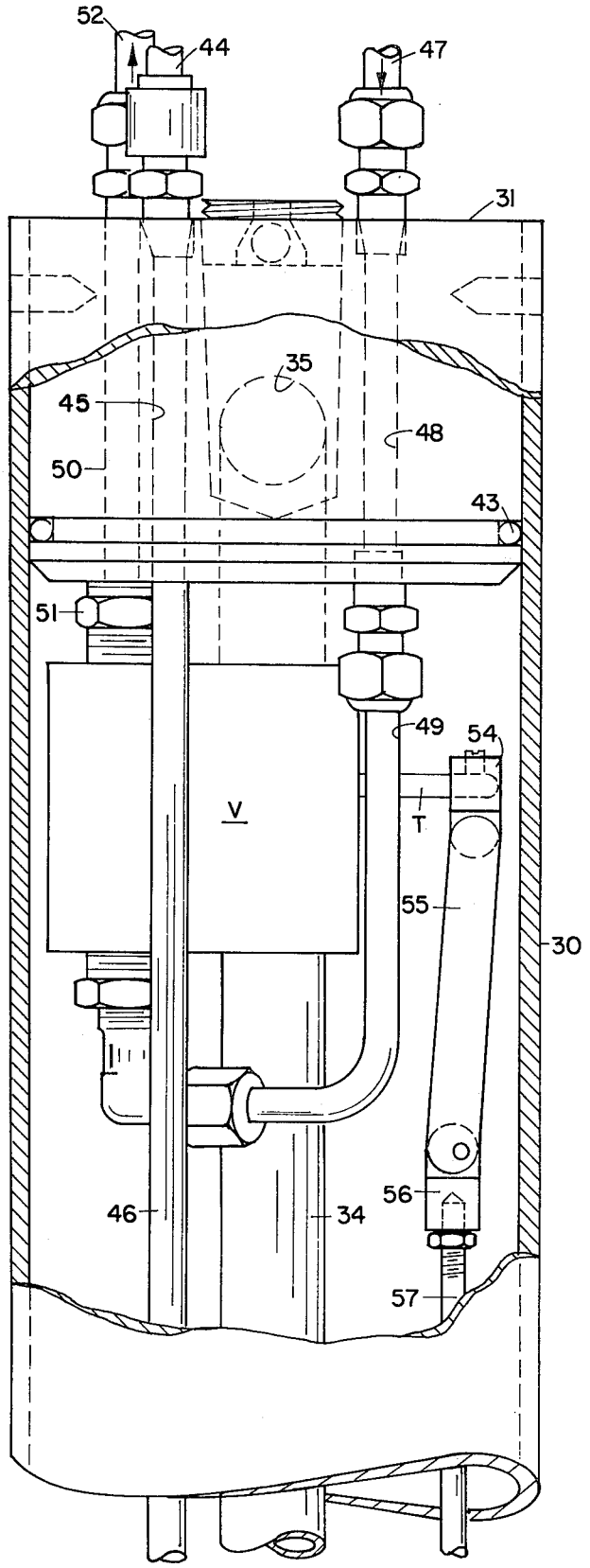

Each of the pumping stages is identical so a detailed description is provided of only one stage. Referring to FIG. 2 of the drawing, there is shown a pumping stage 29. Each stage includes a generally cylindrical housing 30 having an upper cap member 31 and a lower cap member 32. The cap members are designed for interconnecting the stages and for connecting air supply or exhaust lines and the oil producing lines.

Figure 3:
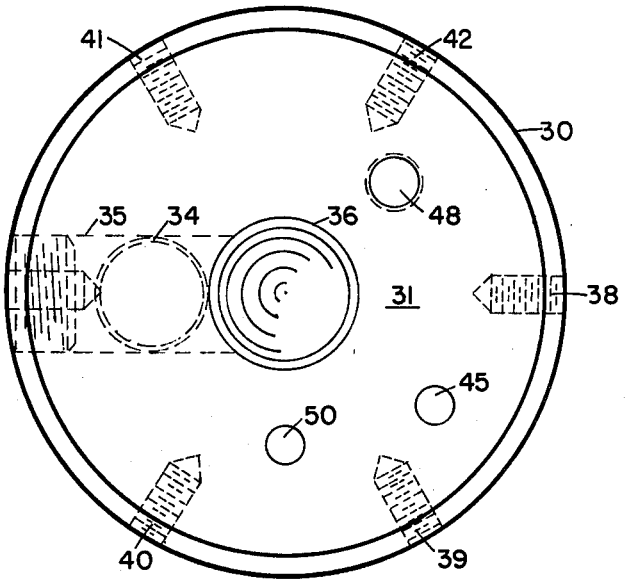
FIG. 3 is a cross-sectional view taken along line 3—3 in FIG. 2*c*.
Figure 4:
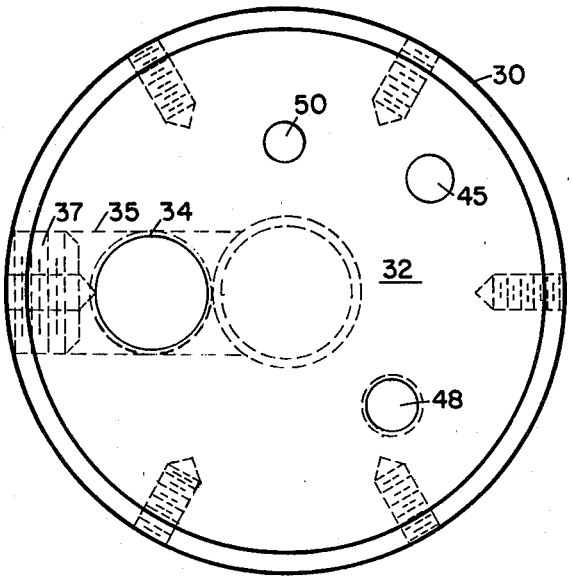
FIG. 4 is a cross-sectional view taken along line 4—4 in FIG. 2*c*.

The upper cap member 31 is sealingly secured to the housing as is the lower cap member 32 which defines a chamber 33. The chamber 33 receives oil from the formation in the case of the lower pumping stage or from the adjacent lower pumping stage in the case of the pumping stages positioned above the lower pumping stage. Positioned in the chamber 33 is an oil exhaust line 34 which is off-set from the center as best shown in FIGS. 3 and 4. A transverse channel 35 in the upper cap member connects the oil exhaust line 35 to a second oil exhaust line 36 which extends upwardly from each pumping stage. The transverse channel is formed by boring a hole into the cap member to connect the oil producing lines 34 and 36. A plug 37 is provided to close off the channel from the exterior of the cap mwmber. As will be apparent, the cap member is secured in the cylindrical housing 30 with a plurality of set screws 38, 39, 40, 41, and 42 as shown in FIGS. 3 and 4. An O-ring is provided to provide a seal between the cap member and the housing.

As shown in FIG. 2(*a*), an air supply line 44 from the surface is connected to the cap member 31. A channel 45 extends through the cap member to communicate with the air supply line 44 and an air supply line 46 which extends through the chamber 33 to the lower cap member where it may be connected to the next stage.

Air is supplied to the stage 29 through air supply line 47 as shown in FIG. 2(*a*). The air supply line 47 is connected to the air supply 44 by means of a tee as best shown in FIG. 1. A channel 48 extends through the cap member 31 to supply air from the air supply line 47 to another air supply line 49 which is connected to the toggle valve V having toggle control T.

The toggle valve V is connected to an exhaust conduit 50 as best shown in FIG. 2(*c*) by means of a connector 51. The exhaust channel 50 is connected to an exhaust line 52 shown in FIG. 2(*a*).

Figure 2B:
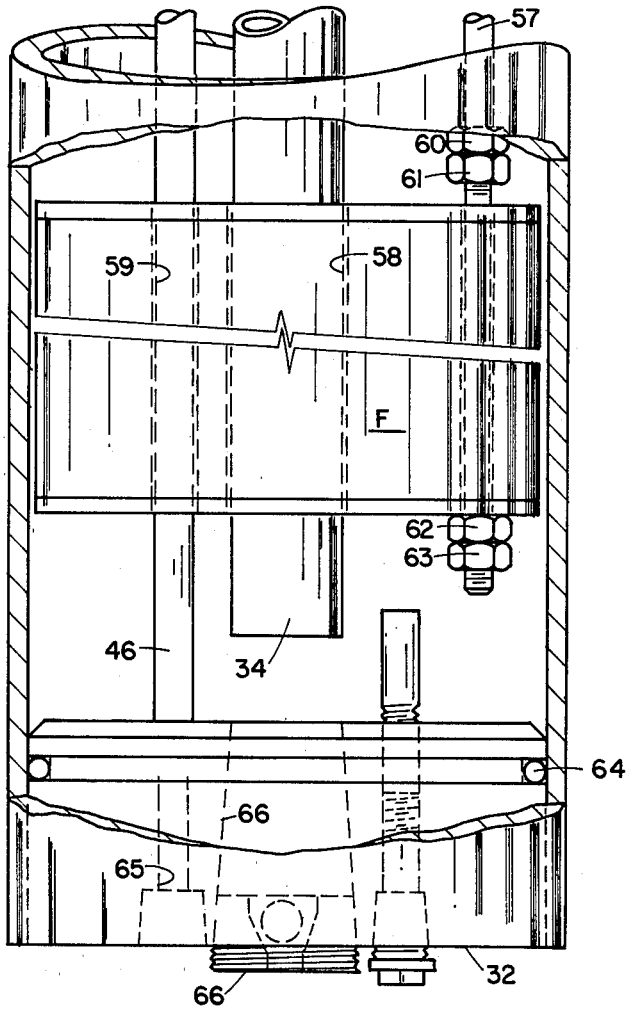
Figure 5:
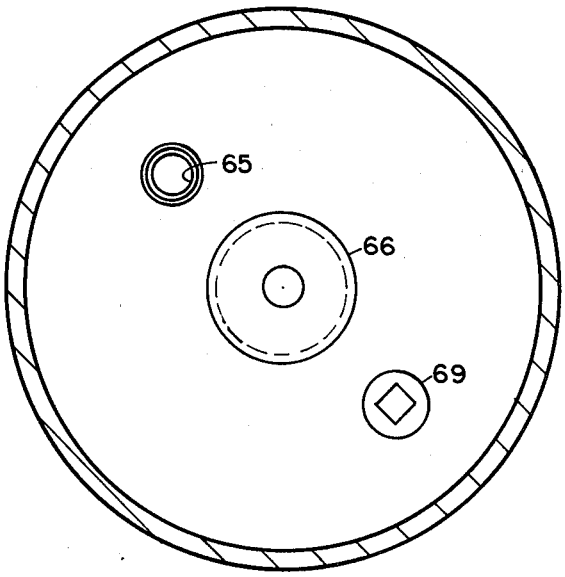
FIG. 5 is a cross-sectional view taken along line 5—5 in FIG. 2.
Figure 2C:
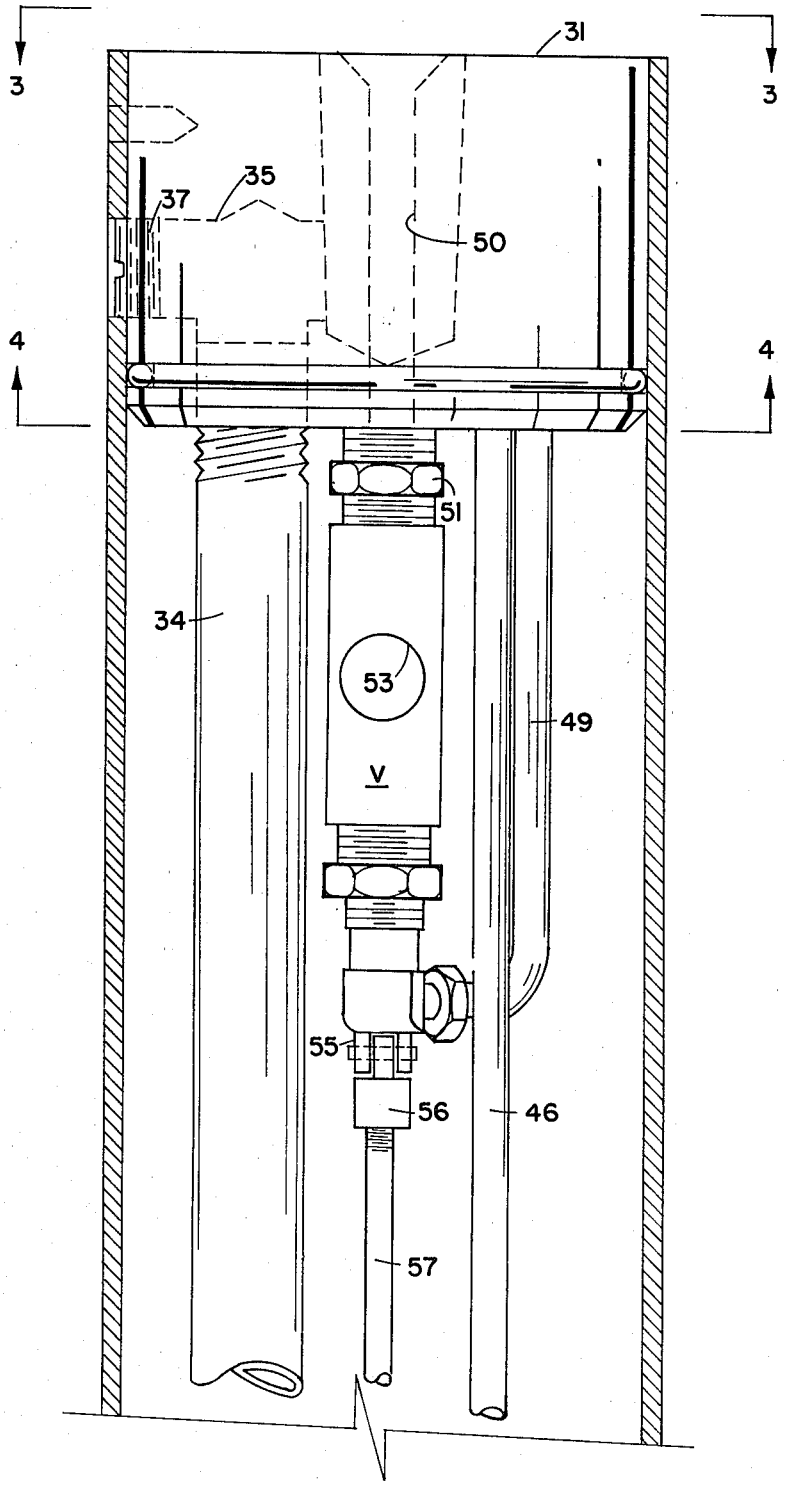

In operation the toggle valve V, with a mechanism as disclosed in U.S. Pat. No. 2,860,660, supplies pressurized air through the opening 53 as shown in FIG. 2(*c*) or allows air within the chamber 33 to exhaust through the opening 53 when the chamber is being filled with oil. In FIG. 2 the toggle valve V is shown in its air supply position whereby air is being supplied to the chamber 33. In FIG. 2(*a*) the toggle valve V is shown in its air exhaust position whereby air is allowed to exhaust from the chamber 33 as it is filled with oil. Secured to the toggle control T is a connector member 54 which is pivotally connected to a link 55. Link 55 is in turn pivotally connected to another connector 56 which is connected to adjustable control rod 57. A control rod 57 extends downward to where it is connected to a float F as shown in FIGS. 2 and 2*b*. The Float F comprises a sealed container having a passageway 58 therethrough for slidably receiving the oil producing line 34. The float F includes another passage 59 for slidably receiving the air supply line 46. Taps 60, 61, 62, and 63 allow the control rod 57 to be adjustably connected with the float. They also provide a loss motion connector so that the weight of the float is not on the toggle control T except when it is desired to activate the valve. This protects the valve from strain or damage whent the float is in its lowermost position at rest on the stop 67 and during the filling of the chamber before it is desired to open the valve and supply pressurized air to the chamber.

The lower cap member 32 is sealingly secured with the housing 30 in the same manner as the upper cap 31. An O-ring 64 is provided to provide the seal. The cap member 32 includes a passageway 65 extending thereto for connecting with air supply line 46. In the case of the lower stage, the passage way 65 would be merely capped off. The lower cap 32 includes a second passageway 66. As shown in FIG. 2(*b*), a check valve 66 may be provided for the lower stage. All stages above the lower state would be connected to an oil exhaust line such as oil exhaust line 6 which would likewise be connected with the lower cap member of the next stage through another check valve.

In operation, the oil enters the chamber 33 though check valve 66. The toggle valve V is in the position shown in FIG. 2 which allows air to exhaust through line 52. When the float F reaches an upper predetermined condition, it will engage the tap 61 and any further upward movement of the float F will apply pressure the toggle valve V and toggle control T through the control rod 57. When the oil reaches a predetermined level, sufficient force will be applied to the toggle control T to overcome the predetermined force necessary to move it to its air supply position as shown in FIG. 2(*a*). The buoyancy of the float is predetermined to supply the sufficient force. This will result in air being supplied to the chamber 33 and closing of the exhaust line 52. Oil in the chamber will be forced through the oil exhaust line 34 upwardly and outwardly oil exhaust line 36. As the oil is forced through the oil exhaust line, the float F will again move downward until it engages the tap 62. The weight of the float F is such that it will overcome the predetermined force necessary to move the toggle control T from the position shown in FIG. 2(*a*) to that shown in FIG. 2 whereby the air supply will be cut off and the air exhaust line will again be connected through the chamber 33.

The toggle V provides quick and certain connection of the chamber 33 of the air supply line or the air exhaust line. The tap 61 and 62 can be positioned so that the float activates the toggle control at a predetermined position of the float within the chamber. The float has a predetermined volume for bouyancy and weight which is selected to properly activate the toggle control T.

A stop member 67 is positioned through passageway 68 to engage the lower surface of the float. The stop member 67 can be adjustably positioned to determine the lower most limit of the float F. A cap member 69 is provided to seal the passageway 68. Passageway 65 is sealed in the case of the lower unit with a plug such as plug 69. In the case of stages above the lower stage the air supply line 44 would be connected with the passageway 65.

Although the invention has been described in conjunction with the foregoing specific embodiment, many alternatives, variations and modifications will be apparent to those of ordinary skill in the art. Those alternatives, variations and modifications are intended to fall within the spirit and scope of the appended claims.

What is claimed is:

1. An automatic gas operated downhole fluid pump, comprising:

an elongated cylindrical chamber for receiving fluid and having a concentrically mounted cylindrical float with a predetermined buoyancy and weight mounted therein for vertical reciprocating movement in said cylindrical chamber responsive to rising and falling of fluid in said cylindrical chamber;

a valve operably connected with the cylindrical float to automatically communicate a source of pressurized gas with the cylindrical chamber for injecting pressurized gas into the cylindrical chamber when fluid in the cylindrical chamber rises and moves the cylindrical float upwardly in the cylindrical chamber to a predetermined height to force the fluid from the cylindrical chamber;

said valve having an actuator biased and retained in either an open or closed position and actuable to either the open or closed position upon movement of the cylindrical float within the cylindrical chamber as the fluid rises and falls to predetermined levels;

said cylindrical float being connected with the valve actuator by a lost motion connector including a vertically disposed elongated control rod connected at one end with the valve actuator and extending through a passageway through the cylindrical float with spaced adjustable tap means to adjustably connect the control rod with the cylindrical float to apply force to the actuator only when it is desired to actuate the valve;

said elongated cylindrical chamber being formed from a cylindrical housing enclosed by upper and lower cap members;

an air supply line extending between the upper and lower cap members to supply air between pump stages;

an oil discharge line being provided within the cylindrical chamber for flowing fluid from the cylindrical chamber during pumping;

said cylindrical float including passageways therethrough which are slidably mounted upon the air supply line and the oil discharge line; and said lower cap member including an adjustable stop member to allow the cylindrical float to move to a predetermined lower limit within the cylindrical chamber.

* * * * *